US011813497B2

(12) United States Patent
Gatta

(10) Patent No.: US 11,813,497 B2
(45) Date of Patent: Nov. 14, 2023

(54) PARALLEL RESISTANCE ROWING MACHINE

(71) Applicant: Christopher Anthony Gatta, Niles, OH (US)

(72) Inventor: Christopher Anthony Gatta, Niles, OH (US)

( * ) Notice: Subject to any disclaimer, the term of this patent is extended or adjusted under 35 U.S.C. 154(b) by 270 days.

(21) Appl. No.: 17/409,690

(22) Filed: Aug. 23, 2021

(65) Prior Publication Data

US 2022/0088435 A1 Mar. 24, 2022

Related U.S. Application Data

(60) Provisional application No. 63/082,301, filed on Sep. 23, 2020.

(51) Int. Cl.
*A63B 22/00* (2006.01)
*A63B 21/008* (2006.01)
(Continued)

(52) U.S. Cl.
CPC ..... *A63B 22/0076* (2013.01); *A63B 21/0088* (2013.01); *A63B 21/225* (2013.01);
(Continued)

(58) Field of Classification Search
CPC ..... A63B 21/005; A63B 21/0051; A63B 21/0052; A63B 21/0056; A63B 21/0057; A63B 21/008; A63B 21/0084; A63B 21/0085; A63B 21/0088; A63B 21/15; A63B 21/157; A63B 21/22; A63B 21/225; A63B 21/4033; A63B 21/4035; A63B 21/4045; A63B 22/0076; A63B 22/20; A63B 22/201; A63B 22/203; A63B 2022/0079; A63B 24/0062; A63B 69/06;
(Continued)

(56) References Cited

U.S. PATENT DOCUMENTS 228,800 A * 6/1880 Barker et al. ..... A63B 22/0076 482/63
885,871 A * 4/1908 Scanlan ..... A63B 22/0076 482/72
(Continued)

OTHER PUBLICATIONS

Nordictrack, RW200, https://www.nordictrack.com/rowing-machines.
Sunny Health & Fitness, Sunny Health & Fitness SF-RW5622, https://www.amazon.com/Sunny-Health-Fitness-Function-Multi-Exercise/dp/B01M8GSBON.

*Primary Examiner* — Gary D Urbiel Goldner

(57) ABSTRACT

A parallel resistance rowing machine is an apparatus that provides adjustable, independent resistance to a user to perform rowing exercises that isolate and emphasize various laterally opposed muscle groups. The parallel resistance rowing machine uses a first resistance assembly and a second resistance assembly mounted to an axle within a chassis. The first resistance assembly and the second resistance assembly are selectably interconnected by a clutch mechanism, enabling a first handle and a second handle to be moved independently or in concert under resistance from the first resistance assembly and the second resistance assembly, respectively. An elongate frame supports a slidable seat assembly, further supporting a full-body rowing action as the user exerts themselves against the first resistance assembly and the second resistance assembly.

20 Claims, 12 Drawing Sheets

(51) Int. Cl.

| | |
|---|---|
| ***A63B 22/20*** | (2006.01) |
| ***A63B 71/06*** | (2006.01) |
| ***A63B 24/00*** | (2006.01) |
| ***A63B 21/00*** | (2006.01) |
| ***A63B 21/22*** | (2006.01) |

(52) U.S. Cl.
CPC ..... *A63B 21/4035* (2015.10); *A63B 22/203* (2013.01); *A63B 24/0062* (2013.01); *A63B 71/0622* (2013.01); *A63B 2022/0079* (2013.01); *A63B 2220/833* (2013.01)

(58) Field of Classification Search
CPC ..... A63B 2069/062; A63B 71/0619; A63B 71/0622; A63B 2208/0228; A63B 2208/0233; A63B 2208/0238; A63B 2220/17; A63B 2220/34; A63B 2220/44; A63B 2220/80; A63B 2220/83; A63B 2220/833
See application file for complete search history.

(56) References Cited

U.S. PATENT DOCUMENTS 4,396,188 A * 8/1983 Dreissigacker .... A63B 22/0076 482/73
4,674,741 A * 6/1987 Pasierb, Jr ..... A63B 21/153 482/72
4,743,011 A * 5/1988 Coffey ..... A63B 21/0088 482/73
4,789,153 A * 12/1988 Brown ..... A63B 24/00 482/73
4,875,674 A * 10/1989 Dreissigacker .... A63B 22/0076 482/901
4,886,287 A * 12/1989 Krause, II ..... B62M 1/16 280/246
4,984,986 A * 1/1991 Vohnout ..... A63B 69/06 73/379.06
5,072,929 A * 12/1991 Peterson ..... A63B 22/0012 310/105
5,382,210 A * 1/1995 Rekers ..... A63B 21/157 482/125
5,707,322 A * 1/1998 Dreissigacker .... A63B 21/4015 482/908
5,961,423 A * 10/1999 Sellers ..... A63B 22/0605 482/52
6,231,485 B1 * 5/2001 Dreissigacker .... A63B 22/0076 482/57
6,371,892 B1 * 4/2002 Dreissigacker .... A63B 21/4001 74/594.6
6,561,955 B1 * 5/2003 Dreissigacker .... A63B 21/0088 482/57
7,201,708 B2 * 4/2007 Dreissigacker .. A63B 21/00069 482/57
7,731,637 B2 * 6/2010 D'Eredita ..... A63B 21/154 482/92
7,946,964 B2 * 5/2011 Gothro ..... A63B 69/06 482/73
7,955,234 B1 * 6/2011 Pursley ..... A63B 21/4047 482/133
8,192,332 B2 * 6/2012 Baker ..... A63B 69/06 482/133
8,235,874 B2 8/2012 D'Eredita
8,608,626 B2 12/2013 Campbell
9,764,186 B2 * 9/2017 Dalebout ..... A63B 69/06
9,770,622 B2 * 9/2017 Campanaro ..... A63B 22/0089
10,155,131 B2 * 12/2018 Machovina ..... A63B 21/153
10,426,994 B1 * 10/2019 Campanaro ..... A63B 17/04
10,449,410 B2 * 10/2019 Hamilton ..... A63B 21/008
10,518,125 B2 * 12/2019 Janowski ..... A63B 22/0076
10,556,167 B1 * 2/2020 Machovina ..... A63B 21/153
10,610,725 B2 * 4/2020 Schaefer ..... G16H 20/30
10,625,114 B2 * 4/2020 Ercanbrack ..... A63B 21/153
10,682,546 B2 * 6/2020 Dubin ..... A63B 71/0054
10,881,936 B2 * 1/2021 Machovina ..... A63B 21/0088
10,967,219 B2 * 4/2021 Reinhardt ..... A63B 22/0089
11,013,952 B2 * 5/2021 French ..... A63B 21/225
11,083,930 B1 * 8/2021 Tipple ..... A63B 22/0076
11,324,991 B2 * 5/2022 Hsieh ..... A63B 21/4034
11,413,494 B1 * 8/2022 Habing ..... A63B 21/225
2001/0008861 A1 * 7/2001 Dreissigacker .... A63B 21/0088 482/111
2002/0016237 A1 * 2/2002 Schmidt ..... A63B 21/015 482/70
2007/0049470 A1 * 3/2007 Pyles ..... A63B 22/0023 482/95
2008/0015095 A1 * 1/2008 Savsek ..... A63B 21/151 482/121
2008/0280736 A1 * 11/2008 D'Eredita ..... A63B 69/06 482/72
2010/0248906 A1 * 9/2010 D'Eredita ..... A63B 69/06 482/72
2011/0028278 A1 * 2/2011 Roach ..... A63B 22/0076 482/72
2011/0082015 A1 * 4/2011 Dreissigacker .. A63B 21/00069 482/72
2012/0100965 A1 * 4/2012 Dreissigacker .... A63B 22/0005 482/72
2017/0361153 A1 * 12/2017 Machovina ..... A63B 21/153
2019/0262654 A1 * 8/2019 Giannelli ..... A63B 23/1209
2020/0023232 A1 1/2020 French

* cited by examiner

PARALLEL RESISTANCE ROWING MACHINE

The current application claims a priority to the U.S. Provisional Patent application Ser. No. 63/082,301 filed on Sep. 23, 2020.

FIELD OF THE INVENTION

The present invention generally relates to the field of personal training equipment, specifically relating to novel improvements to a conventional rowing machine. The present invention recites an assembly of parallel resistance elements enabling simultaneous, independent exercise of opposed muscle groups.

BACKGROUND OF THE INVENTION

Rowing machines, indoor rowers, or sometimes 'ergometers' are common implements in any well-equipped gym. Most conventional rowing machines employ a resistive element fixed to a slide-rail, onto which a seat and foot pedals are mounted. The seat itself is free to traverse across a single axis of the rail, sliding underneath a user to enable full extension and flexion of their legs against the foot pedals. A common iteration of this type of equipment is the 'Dreissigacker/Williams device', wherein the seat moves relative to the foot pedals. In some implementations, the seat and foot pedals are both mounted to independent sliding assemblies to enable greater flexibility or range of motion during exercise; this multi-body arrangement is called a 'Rekers device' to differentiate from simpler designs. Further developments of the conventional rower design relate to the resistive element itself, wherein the outward draw or unspooling of a retracting cable may be counteracted by linear pistons, air resistance (i.e. over-rotation of a fan/turbine), water resistance (similar turbine arrangement, within a sealed fluid reservoir), magnetic resistance (e.g. a manually-driven induction motor), or mechanically-braked flywheel assemblies across multiple known and available embodiments of similar exercise systems. The common element to most current iterations is the use of a single resistive element, with a single retracting cable grasped by a user to provide metered resistive force throughout an exercise session.

It is proposed that the available or supported exercises may be expanded in both form and efficacy with the addition of a second resistive element, adjacent to but independent from each other. This arrangement may be further improved with the addition of a rotationally-adjustable seat, wherein the user may deflect the primary seating position laterally across the rail to enable oblique or core-strength exercises in conjunction with the more conventional exercises associated with indoor rowers. The double-resistance element arrangement is further considered to synergize with the laterally flexible seating arrangement to enable a user to focus and isolate muscle groups that may otherwise be neglected during a simple linear routine.

DETAIL DESCRIPTIONS OF THE INVENTION

Figure 1:
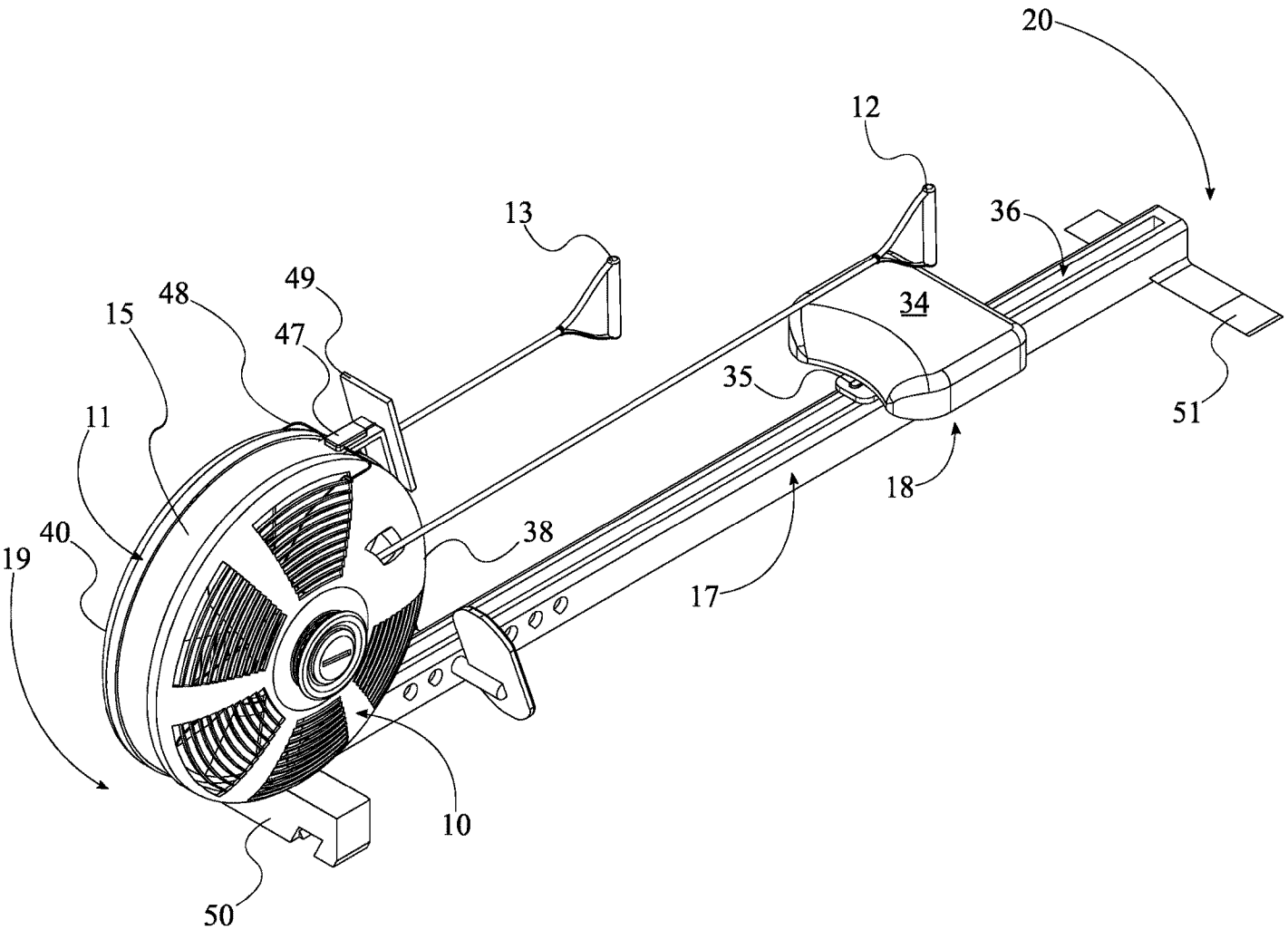
FIG. 1 is a top-front-left isometric view of a simplified embodiment of the present invention.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIG. 1 through 12, the present invention is a parallel resistance rowing machine comprising a first resistance assembly 10, a second resistance assembly 11, a first handle 12, a second handle 13, a clutch mechanism 14, a chassis 15, an axle 16, an elongate frame 17, and a seat assembly 18. The present invention aims to provide a novel exercise system comprising a pair of resistive elements, adjacent to but independent from each other. This arrangement may be further improved with the addition of a rotationally adjustable seat, wherein the user may deflect the primary seating position laterally across the rail to enable oblique or core-strength exercises in conjunction with the more conventional exercises associated with indoor rowers. The double-resistance element arrangement is further considered to synergize with the laterally flexible seating arrangement to enable a user to focus and isolate muscle groups that may otherwise be neglected during a conventional linear routine.

Figure 2:
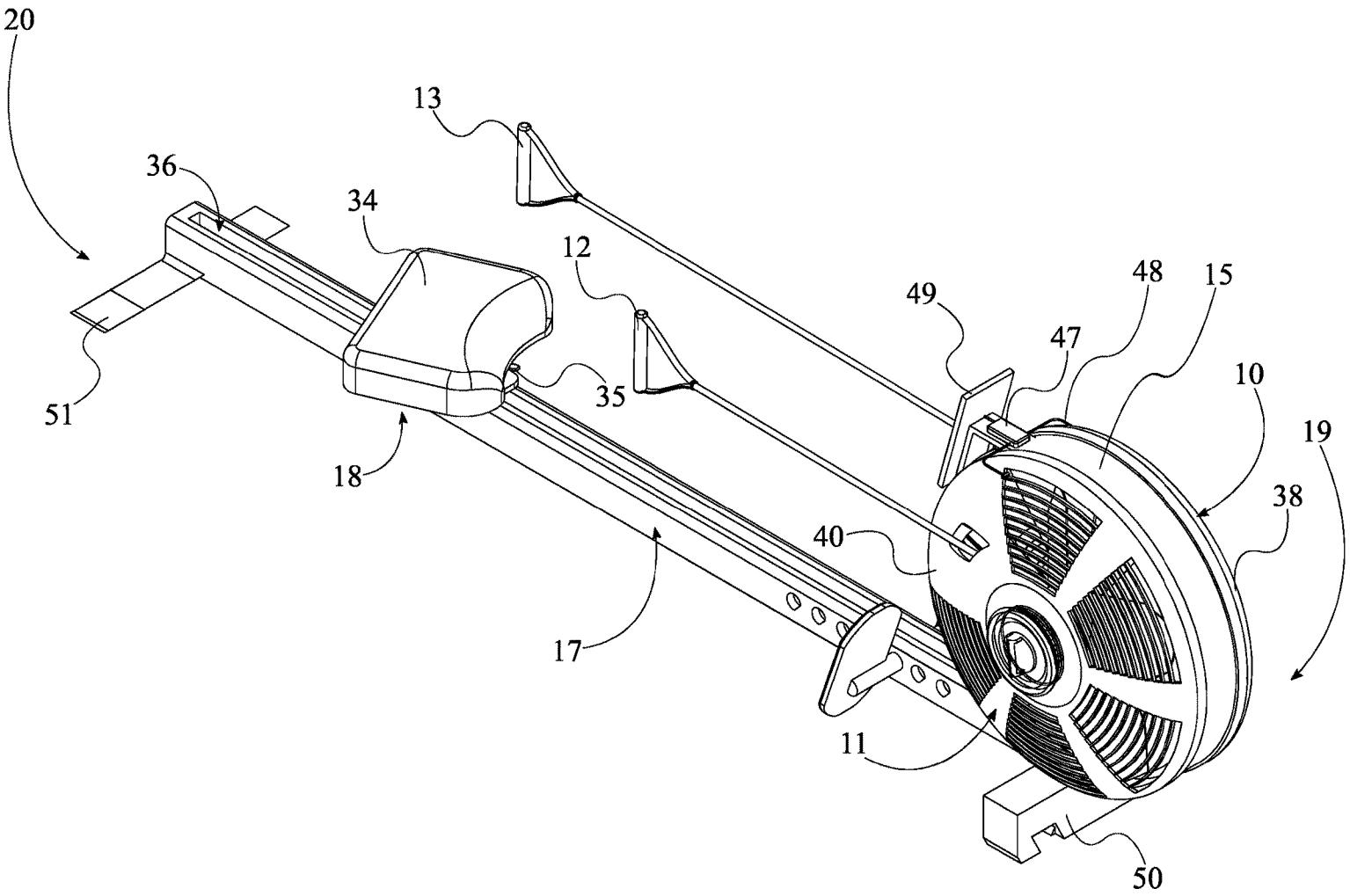
FIG. 2 is a top-front-right isometric perspective view thereof.
Figure 3:
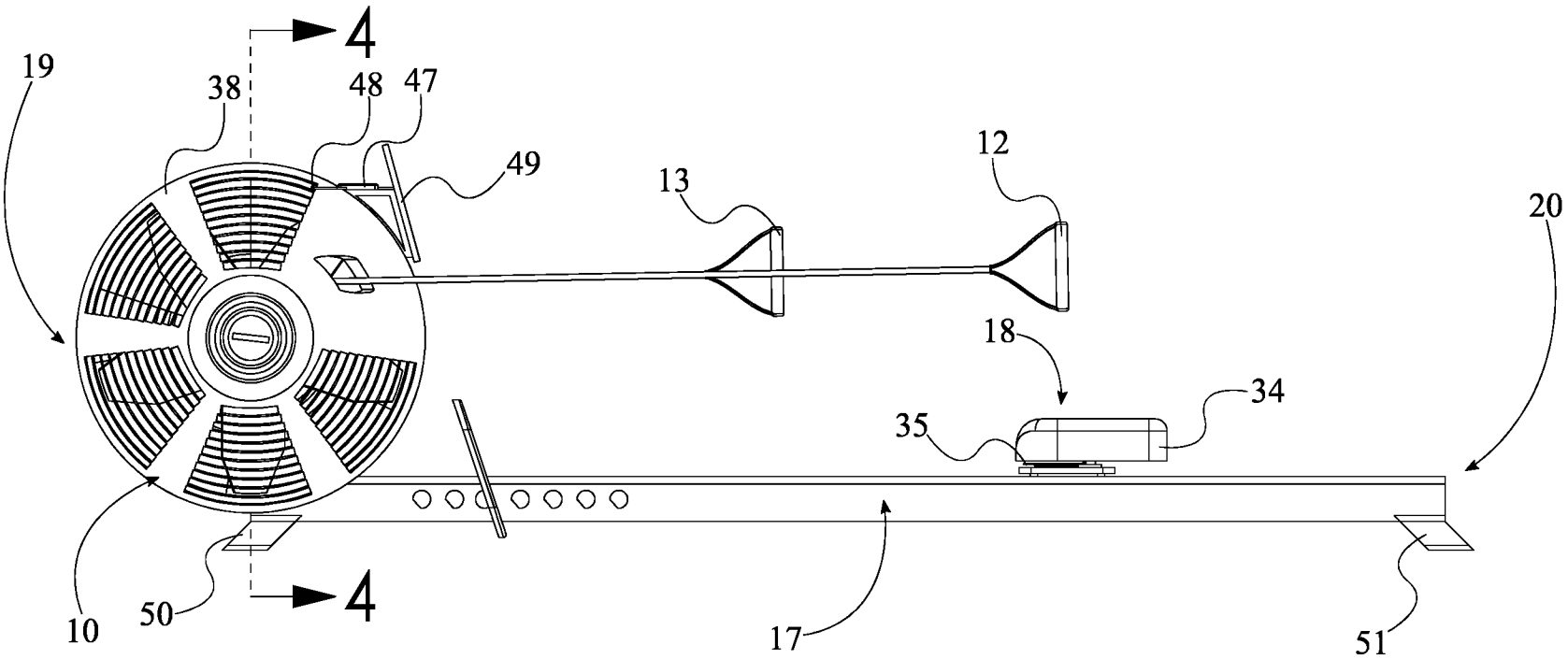
FIG. 3 is a left-side elevational view thereof.

As shown in FIG. 1 through 3, the chassis 15, axle 16, and elongate frame 17 ideally constitute static structural elements of the present invention. More specifically, the elongate frame 17 extends between a proximal end 19 and a distal end 20; the span of the elongate frame 17 generally corresponding to the movement of a user during a rowing exercise in the preferred embodiment. The chassis 15 is mounted to the proximal end 19 of the elongate frame 17 to provide clearance for the first resistance assembly 10 and the second resistance assembly 11 at an offset from the elongate frame 17. The axle 16 is mounted to the chassis 15, ideally positioned concentric to the chassis 15 and perpendicular to the elongate frame 17. This arrangement enables the first resistance assembly 10 and the second resistance assembly 11 to rotate freely within the chassis 15. Accordingly, the first resistance assembly 10 and the second resistance assembly 11 are rotatably mounted to the axle 16, wherein the axle 16 is a static fixture relative to the chassis 15. Any bearing structures, lubricants, or other anti-frictive components and compositions associated with the axle 16 are generally well-understood and should not be construed as limiting to the spirit and scope of the invention.

Figure 7:
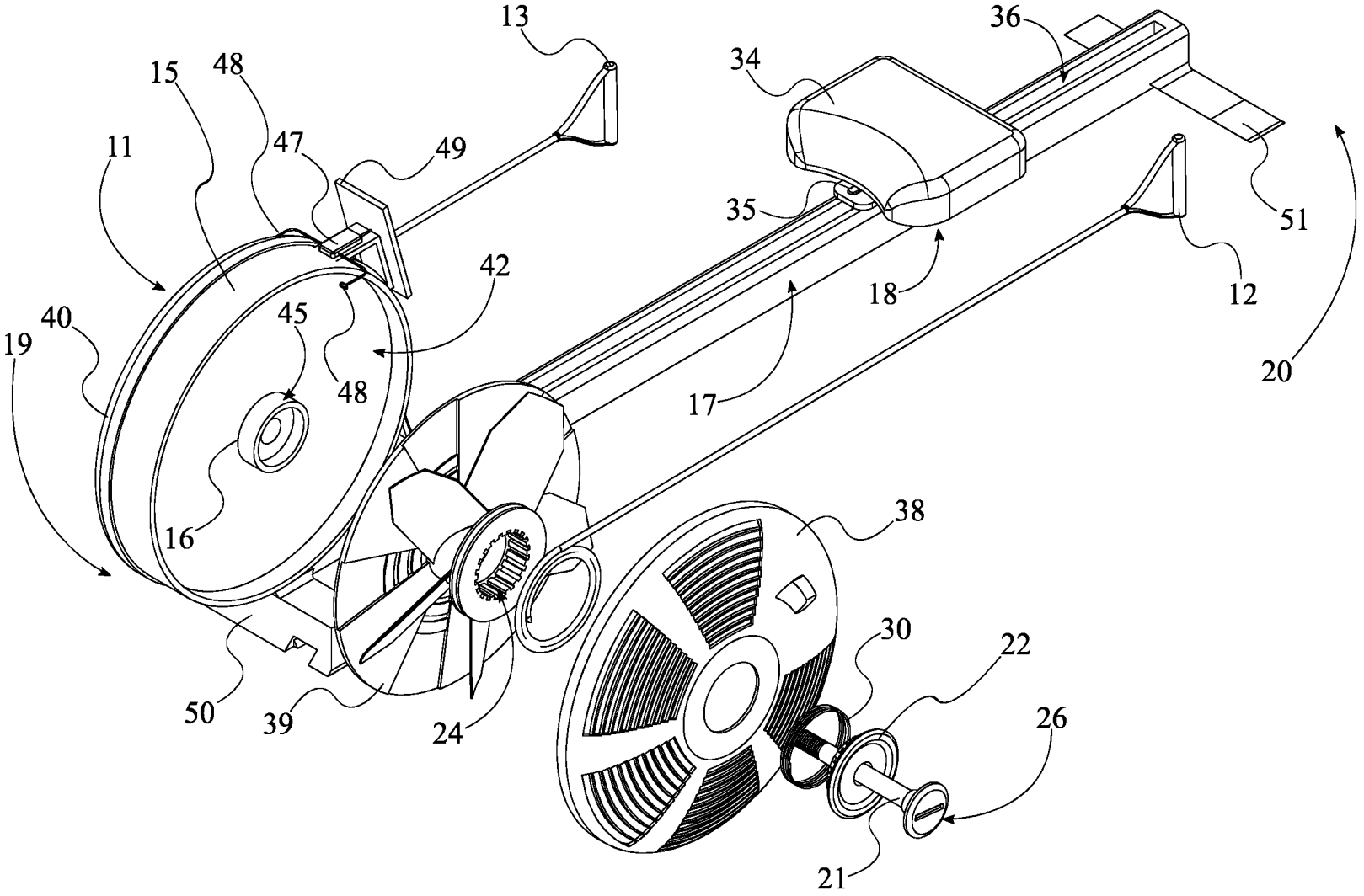
FIG. 7 a top-front-left isometric exploded view of the present invention.
Figure 8:
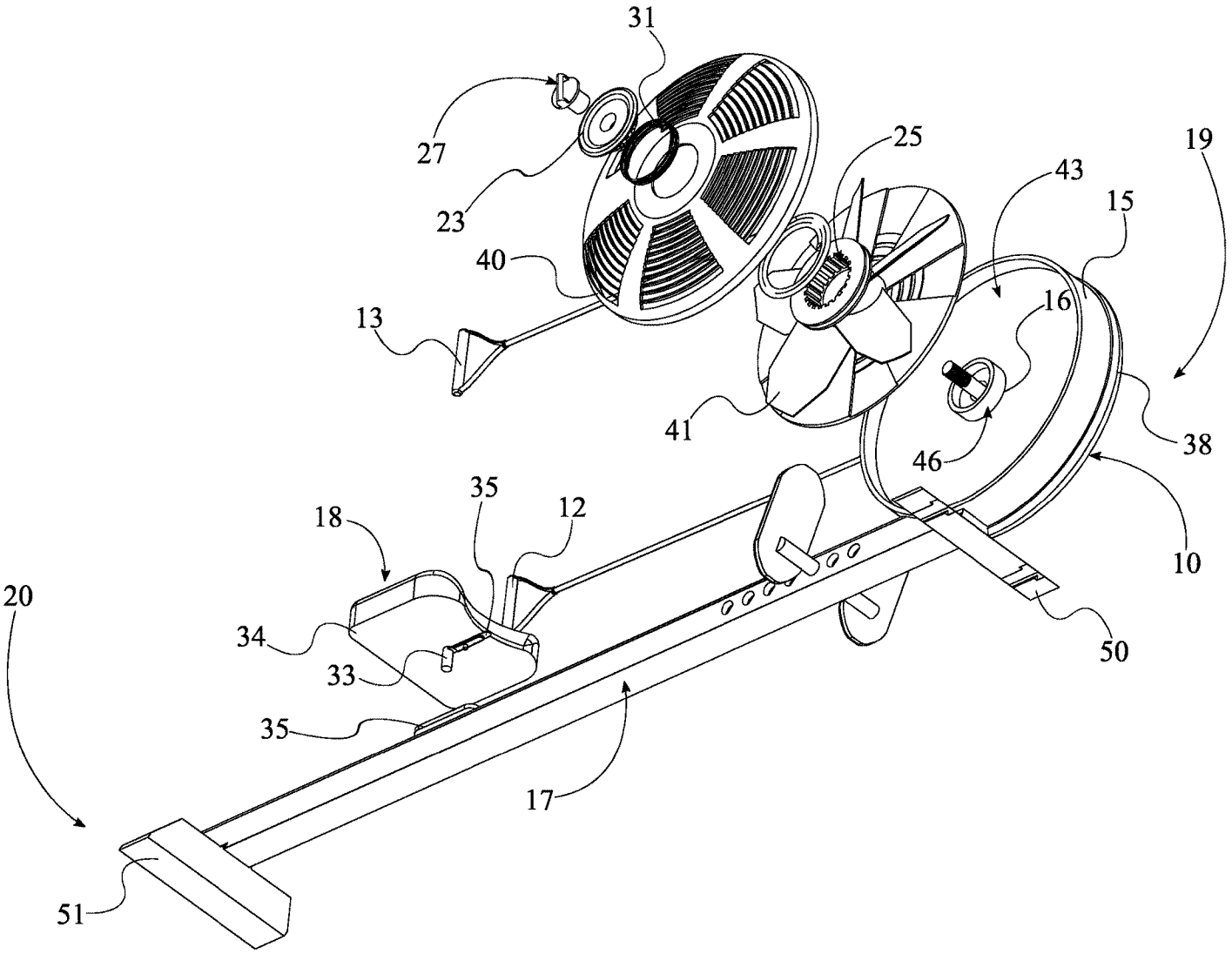
FIG. 8 top-front-right isometric perspective view thereof.
Figure 9:
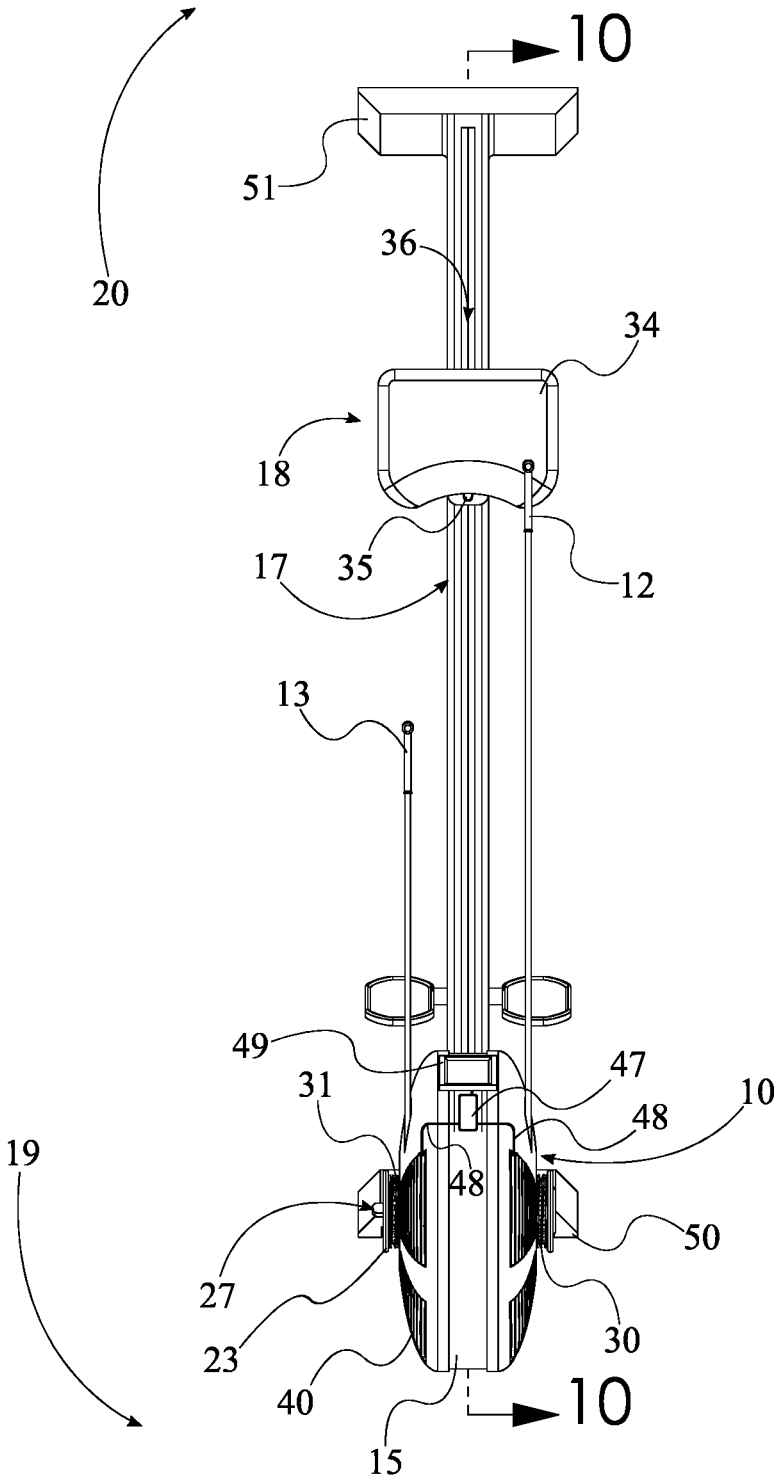
FIG. 9 is a top plan view of the present invention.

As illustrated in FIGS. 7 and 8, the first resistance assembly 10 and the second resistance assembly 11 are positioned opposite each other across the axle 16, thereby enabling the first handle 12 and second handle 13 to be drawn parallel to the elongate frame 17 during an exercise without binding against the chassis 15. The first resistance assembly 10 and the second resistance assembly 11 ideally constitute similar, independently operable torsional brakes configured to provide resistance against a use's full range of motion during an exercise. Though the present invention is ideally configured to provide mono-directional resistance against the first handle 12 and second handle 13 (i.e., resist drawing the first handle 12 away from the first resistance assembly 10 and the second handle 13 away from the second resistance assembly 11) in support of a rowing exercise, it is broadly contemplated that the resistances of the first resistance assembly 10 and the second resistance assembly 11 may be configured for reversed or bi-directional resistance in various alternate embodiments and modes of use.

The first handle 12 is torsionally engaged to the first resistance assembly 10 and the second handle 13 is torsionally engaged to the second resistance assembly 11. Further, the clutch mechanism 14 is operably engaged between the first resistance assembly 10 and the second resistance assembly 11, wherein the first resistance assembly 10 and the second resistance assembly 11 are rotationally coupled by the clutch mechanism 14. The clutch mechanism 14 refers to any operable means of binding the first resistance assembly 10 and the second resistance assembly 11 together, whereby the resistance across the first handle 12 and the second handle 13 is at least partially equalized. In one embodiment, the clutch mechanism 14 configures the first resistance assembly 10 and the second resistance assembly 11 to exert proportional resistance across the first handle 12 and the second handle 13, wherein the sum of the resistance of both the first resistance assembly 10 and the second resistance assembly 11 is exerted across both the first handle 12 and the second handle 13. In at least one alternate embodiment, the clutch mechanism 14 engages the first resistance assembly 10 and the second resistance assembly 11 to exert disproportionate resistance between the first handle 12 and the second handle 13, wherein either the first handle 12 or the second handle 13 may selectably offer greater or lesser resistance to target selected muscle groups during an exercise.

In reference to FIG. 9 through 12, the seat assembly 18 is slidably mounted to the elongate frame 17, wherein the seat assembly 18 traverses the elongate frame 17 between the proximal end 19 and a distal end 20. This arrangement is generally similar to conventional rowing machines, wherein the range of motion of the seat assembly 18 along the elongate frame 17 generally corresponds to the difference between the user's flexed and extended leg. Accordingly, the seat assembly 18 is configured to enable the use of the selectable resistance offered by the first resistance assembly 10, the second resistance assembly 11, and the clutch mechanism 14 in a lower-body exercise in addition to any upper-body or core routines.

As outlined above, the first resistance assembly 10 and the second resistance assembly 11 are configured to operate cooperatively or independently via the clutch mechanism 14. Accordingly, the clutch mechanism 14 comprises an arbor 21, a first engagement element 22, a second engagement element 23, a first receiver socket 24, and a second receiver socket 25. The arbor 21 is positioned concentric with the axle 16, wherein the arbor 21 traverses between the first resistance assembly 10 and the second resistance assembly 11. The arbor 21 is an elongate cylindrical member configured to rotate relative to the axle 16 during engagement to either the first resistance assembly 10 or the second resistance assembly 11 but is otherwise unbound to any other moving part at the interstitial position shown in FIG. 4. This arrangement enables the arbor 21 to remain entirely independent of the first resistance assembly 10 and the second resistance assembly 11 when not engaged thereto. This removes the mass of the clutch mechanism 14 from the total rotating mass of the present invention while the clutch mechanism 14 is disengaged between the first resistance assembly 10 and the second resistance assembly 11.

Figure 4:
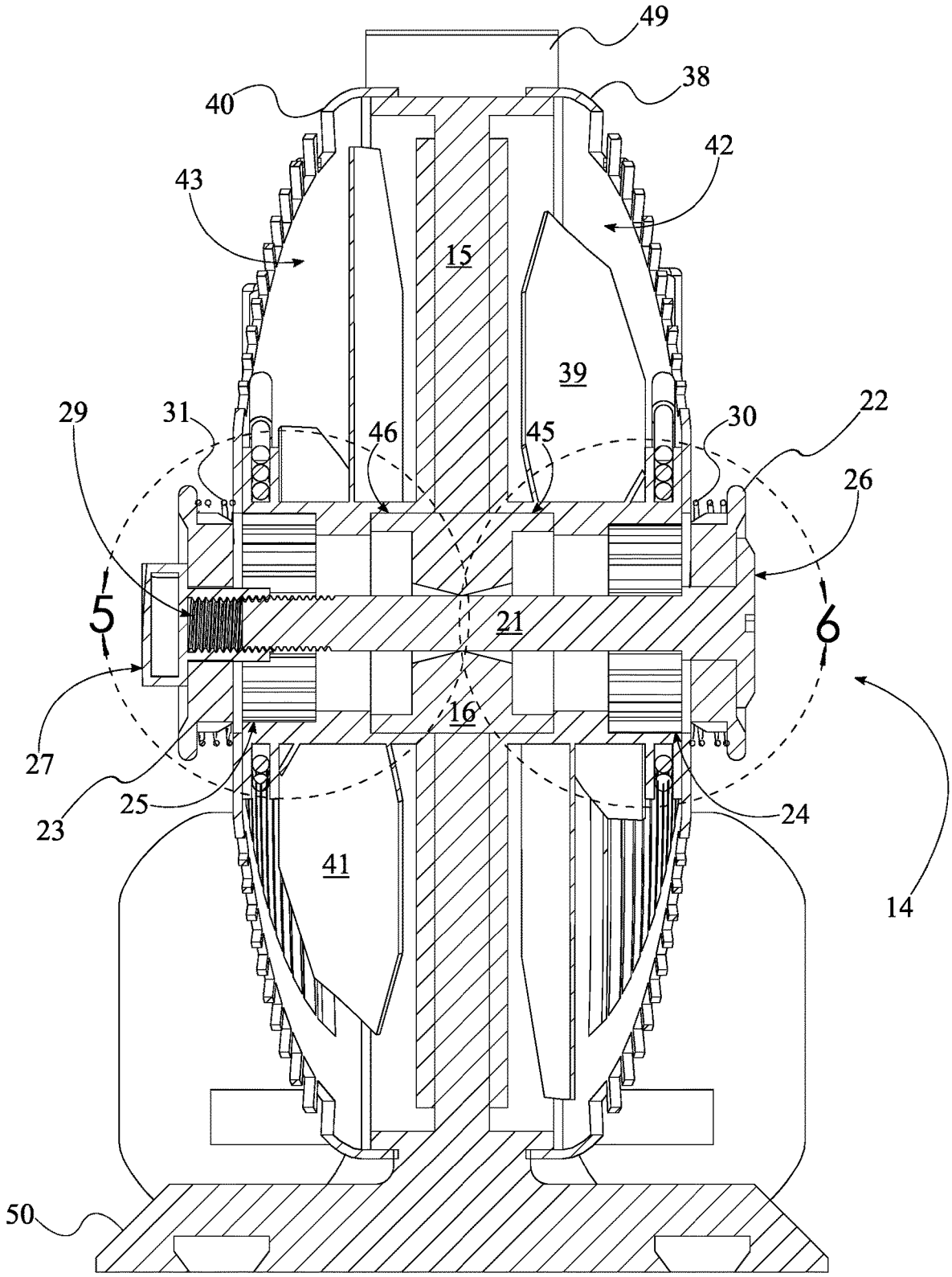
FIG. 4 is a sectional view taken along line 4-4 in FIG. 3.
Figure 5:
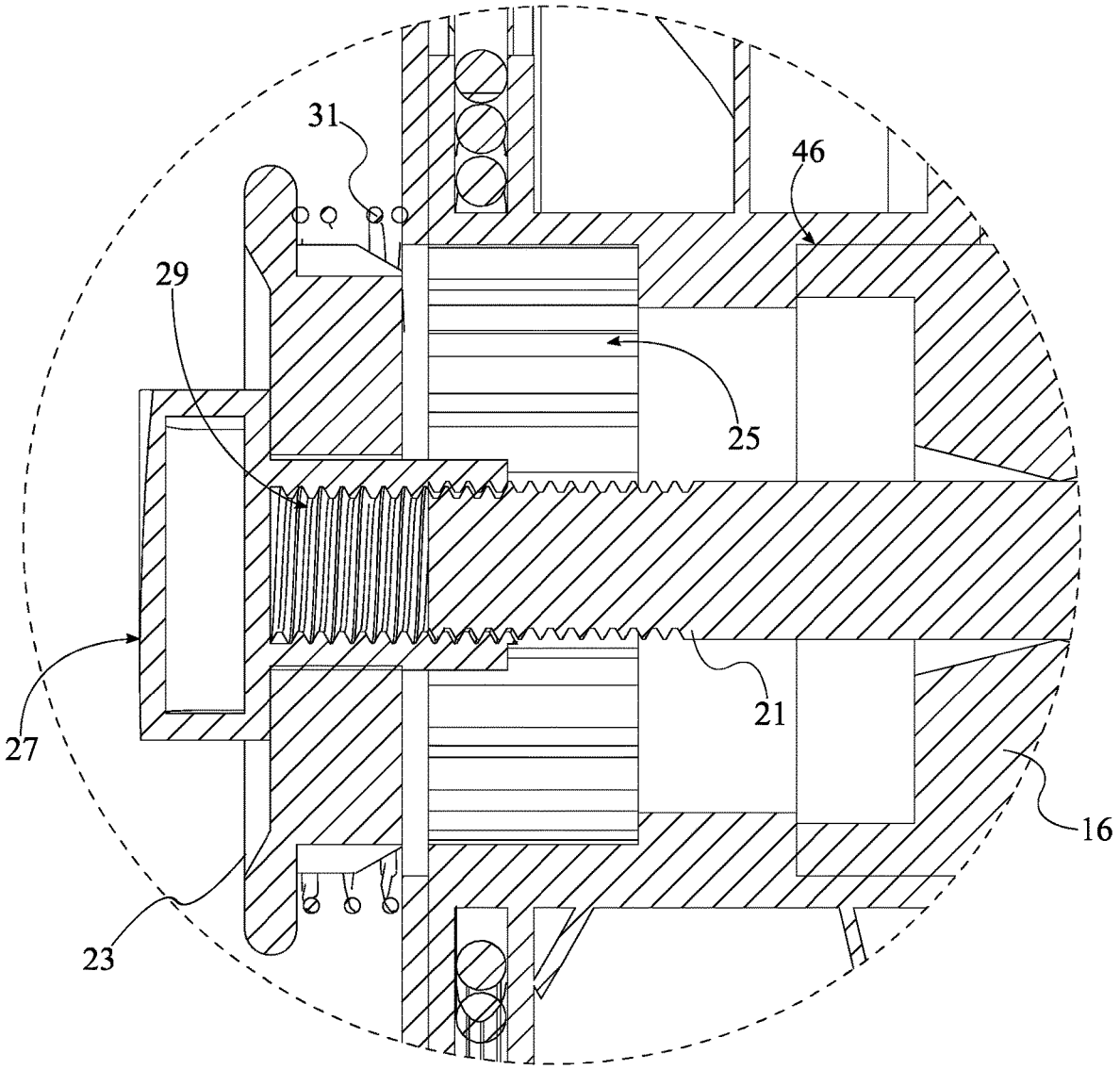
FIG. 5 is a detail view of area 5 in FIG. 4.
Figure 6:
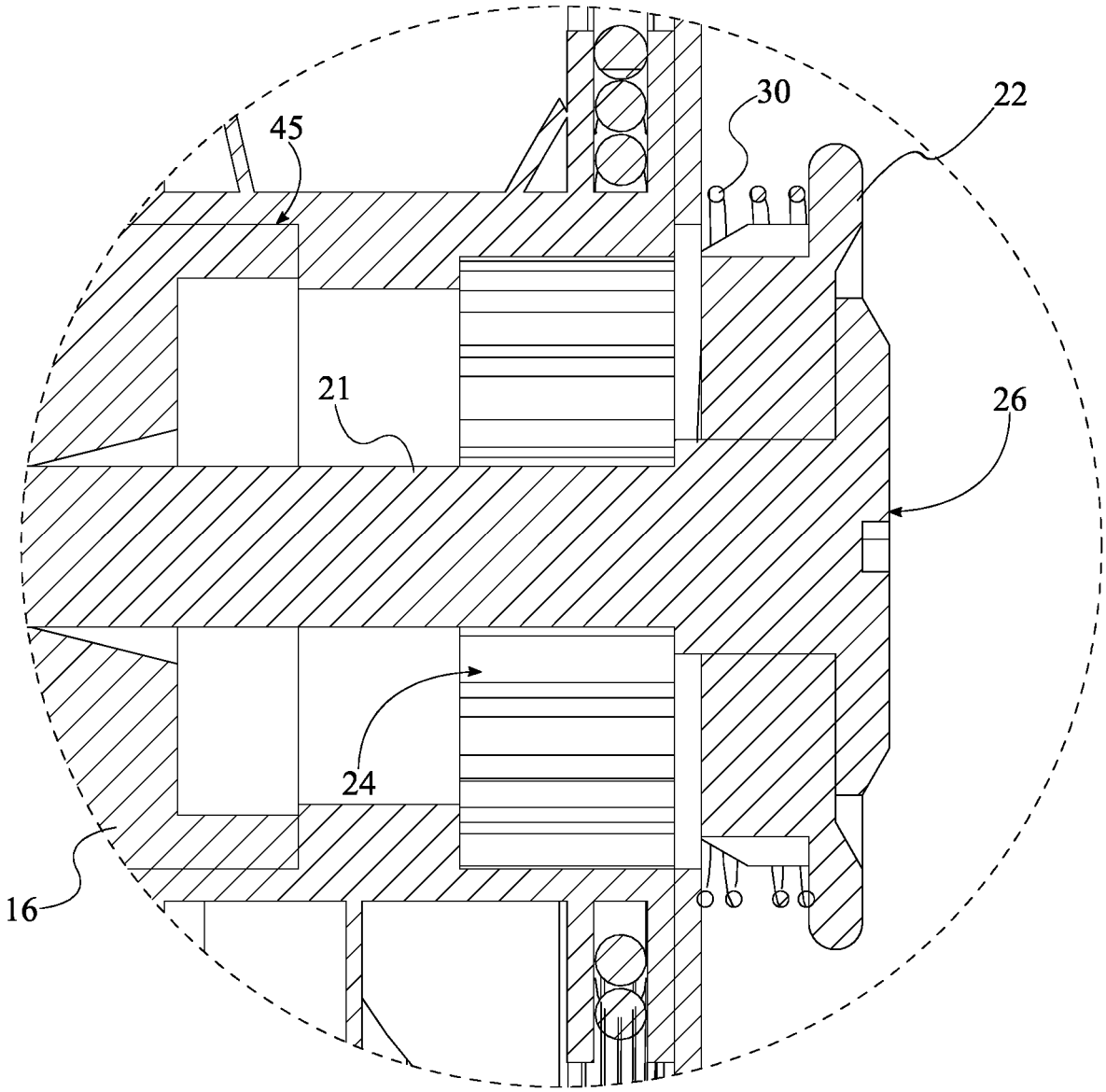
FIG. 6 is a detail view of area 6 in FIG. 4.

In reference to FIGS. 5 and 6, the first engagement element 22 is slidably mounted at a first terminal end 26 of the arbor 21 and the second engagement element 23 is slidably mounted at a second terminal end 27 of the arbor 21, opposite the first engagement element 22. The first engagement element 22 and the second engagement element 23 each define mating structures congruent to the first receiver socket 24 and the second receiver socket 25, respectively. More specifically, the first receiver socket 24 is formed into the first resistance assembly 10 and the second receiver socket 25 is formed into the second resistance assembly 11. The first engagement element 22 is operably engaged into the first receiver socket 24 and the second engagement element 23 is operably engaged into the second receiver socket 25, wherein the first resistance assembly 10 and the second resistance assembly 11 are rotationally coupled through the arbor 21. As shown in FIG. 4 through 6, the preferred embodiment of the first engagement element 22 and the second engagement element 23 are opposed, splined structures positioned adjacent to the first receiver socket 24 and the second receiver socket 25. According to this embodiment, the first receiver socket 24 and the second receiver socket 25 define congruent splined cavities configured to accept the corresponding instances of the first engagement element 22 and the second engagement element 23. Although the splined features shown in the reference figures are exemplary and should not be construed as limiting the scope of the present invention, a rigid mechanical engagement (e.g., splines) is generally preferable in this embodiment to any type of frictive clutch or limited-slip arrangement. In such an embodiment, competing extension and retraction forces exerted across the clutch mechanism 14 would likely allow slippage during a stroke motion by the user. Consequently, the normal pace and flow of an exercise would be interrupted by the momentary 'jerk' of a slipping clutch. It is also understood that the scale and arrangement of the splined members in the associated figures may be exaggerated in the attached figures to illustrate construction and arrangement.

In a preferred embodiment of the present invention the clutch mechanism 14 is operable by a single user, absent the need for any tools or specialized training. It is therefore proposed that the clutch mechanism 14 be released and engaged by a single reversible operation, wherein a user manually fixes or releases the first resistance assembly 10 and the second resistance assembly 11 without requiring direct adjustment of each disparate component. Accordingly, the clutch mechanism 14 further comprises at least one linear adjustment mechanism 29, a first spring, and a second spring 31 as shown in FIG. 5 through 8. The linear adjustment mechanism is mounted to the arbor 21 between the first engagement element 22 and the second engagement element 23, wherein the linear adjustment mechanism operably affects the length of the arbor 21 between the first engagement element 22 and the second engagement element 23. The first spring 30 is positioned between the first receiver socket 24 and the first engagement element 22, wherein the first engagement element 22 is biased away from the first receiver socket 24 by the first spring. The second spring 31 is positioned between the second receiver socket 25 and the second engagement element 23, wherein the second engagement element 23 is biased away from the second receiver socket 25 by the second spring 31.

In the exemplary embodiment shown, the linear adjustment mechanism constitutes a threaded rod engaged into a corresponding threaded hole, thereby allowing the overall length of the arbor 21 to be adjusted via the rotation of the first engagement element 22 relative to the second engagement element 23. The first spring 30 and the second spring 31 maintain tension across the arbor 21, forcing the first engagement element 22 and the second engagement element 23 clear of the first receiver socket 24 and the second receiver socket 25 as the linear adjustment mechanism increases the overall length of the arbor 21. In reverse, the force of the first spring 30 and the second spring 31 are overcome by the linear adjustment mechanism to reengage the first engagement element 22 and the second engagement element 23 into the first receiver socket 24 and the second receiver socket 25.

Figure 10:
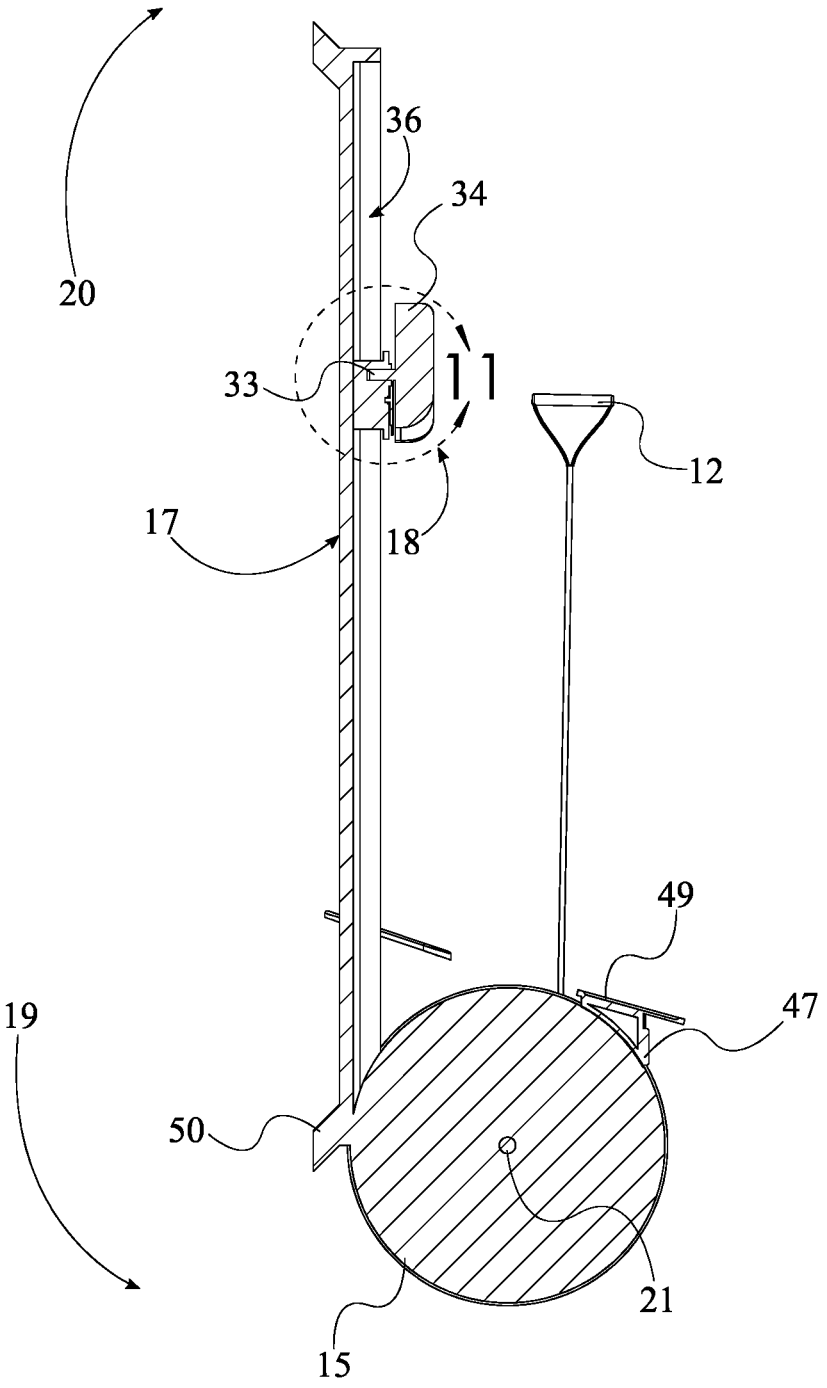
FIG. 10 is a sectional view taken along line 10-10 in FIG. 9.
Figure 11:
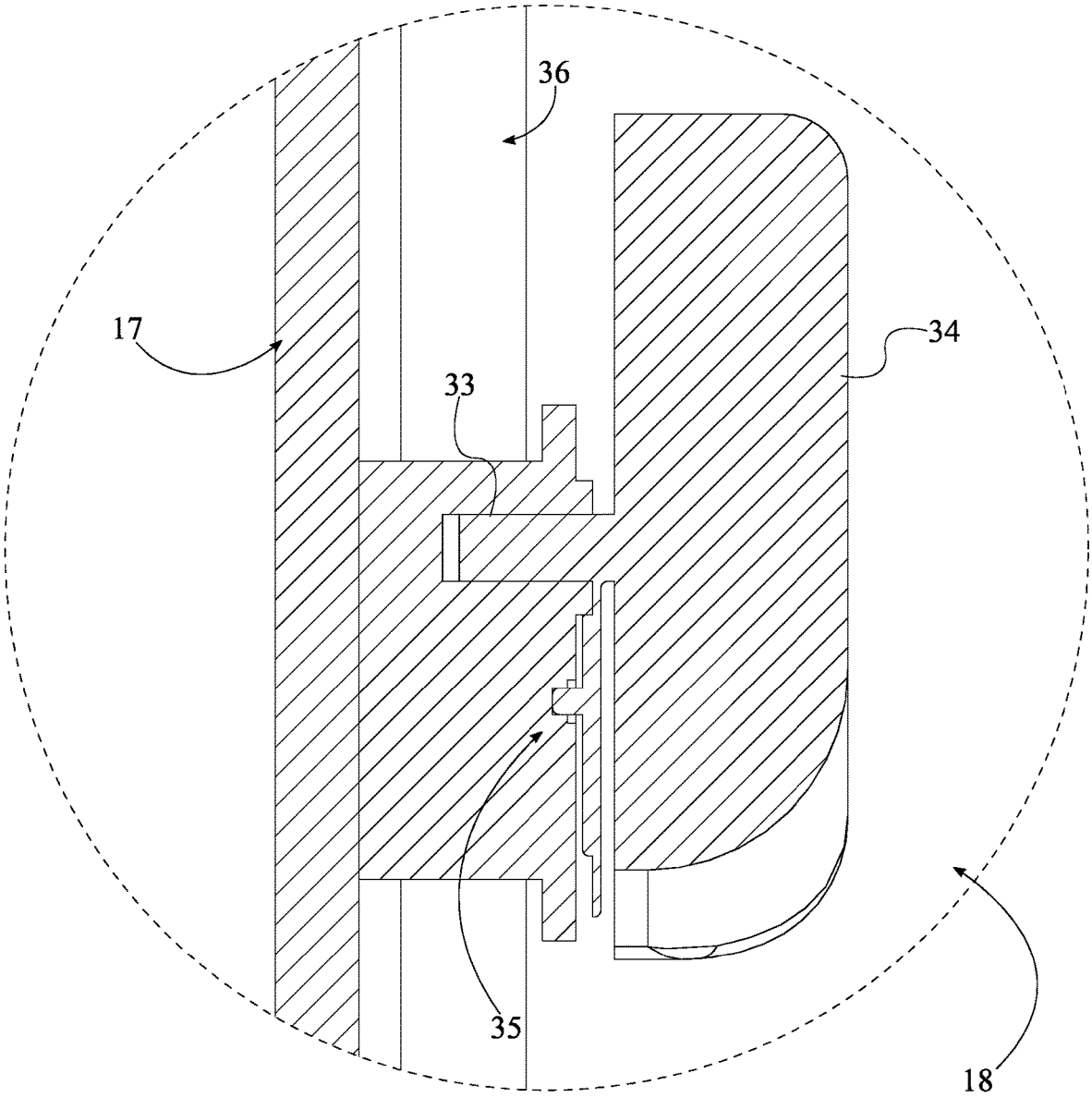
FIG. 11 is a detail view of area 11 in FIG. 10.

Common rowing exercises, as outlined above, typically involve the flexion and extension of major muscle groups in the legs, back, and arms with a particular focus on the linear compression and extension of these muscle groups along a linear 'stroke'. It is therefore advantageous for the seating position to be slidable and adjustable to enable the full flexion and extension of a user's legs during this exercise, enabling a user to selectably isolate muscle groups by fixing or displacing the seating position along the elongate frame 17. Accordingly, the seat assembly 18 further comprises a bearing pin 33, a platform 34, and at least one locking mechanism 35 as shown in FIG. 10. The elongate frame 17 comprises a seat channel 36 extending between the chassis 15 and the distal end 20. The bearing pin 33 is slidably mounted into the seat channel 36, wherein the seat assembly 18 may traverse the elongate frame 17 in at least one configuration. The platform 34 is mounted atop the bearing pin 33, opposite the seat channel 36. The platform 34 is releasably engaged to the elongate frame 17 through the at least one locking mechanism 35. Across a variety of potential embodiments, the at least one locking mechanism 35 broadly refers to any means of rigidly fixing the platform 34 in position relative to the elongate frame 17.

In at least one additional embodiment, it is proposed that a user may benefit from a configuration wherein the platform 34 is positioned at a variable angular offset relative to the frame. In reference to FIG. 11 the bearing pin 33 is rotatably positioned within the seat channel 36. The platform 34 is selectably oriented at an oblique angle to the elongate frame 17 through the at least one locking mechanism 35 as shown in FIG. 2. This configuration enables the user to isolate laterally disposed muscle groups in a fixed configuration, wherein muscles groups to the left or right side of the user's body are directly disposed towards the first resistance assembly 10 and the second resistance assembly 11. Further, the at least one locking mechanism 35 may be unlocked to enable the user to incorporate a twisting motion into each stroke, thereby working both left and right-side lateral muscle groups in alternation.

In the broadest conception of the present invention, the first resistance assembly 10 and the second resistance assembly 11 constitute any type or variety of resistance element suitable for use in exercise equipment. In at least one embodiment, the use of rotation counter-mass is proposed as an optimal source of said resistance, wherein the resistance force generated is immune to the fall-off and variation inherent to pressurized damper systems as they become heat soaked during continuous use. Likewise, elastic elements eventually lose structure and resilience over time and use, thereby weakening the exerted resistance force as a user grows stronger due to regular exercise. Accordingly, the first resistance assembly 10 further comprises a first shell 38 and a first flywheel 39. The second resistance assembly 11 further comprises a second shell 40 and a second flywheel 41. The chassis 15 further comprises a first annular cavity 42 and a second annular cavity 43, wherein the axle 16 traverses between the first annular cavity 42 and the second annular cavity 43. The first flywheel 39 is positioned within the first annular cavity 42 and the second flywheel 41 is positioned within the second annular cavity 43. The first shell 38 is perimetrically mounted over the first annular cavity 42, wherein the first handle 12 traverses through the first shell 38. The second shell 40 being perimetrically mounted over the second annular cavity 43, wherein the second handle 13 traverses through the second shell 40.

The first shell 38 and the second shell 40 individually define protective coverings for the first flywheel 39 and the second flywheel 41, respectively. As shown in FIGS. 7 and 8, the first annular cavity 42 and the second annular cavity 43 provide unobstructed space within the first shell 38 and the second shell 40 for the first flywheel 39 and the second flywheel 41 (again, respectively) to rotate freely about the axle 16. As outlined, the first handle 12 and the second handle 13 are provided with clearance to traverse the first shell 38 and the second shell 40 to enable a user to engage with the first flywheel 39 and the second flywheel 41 without directly exposing themselves to the potentially hazardous spinning masses therein.

A key functionality of the present invention is the selectable independent motion of the first resistance assembly 10 and the second resistance assembly 11 about the axle 16, thereby enabling a multitude of new exercises that are not conventionally possible with standard rowing machines. Accordingly, the axle 16 must provide a rigid central support for both the first resistance assembly 10 and the second resistance assembly 11 while simultaneously enabling the clutch mechanism 14 to operate therethrough. As shown in FIG. 4 the axle 16 comprises a first bearing structure 45 and a second bearing structure 46, wherein the first bearing structure 45 and the second bearing structure 46 define smooth rotational races suitable for supporting the first resistance assembly 10 and the second resistance assembly 11. The first bearing structure 45 is mounted within the first annular cavity 42 to support the first resistance assembly 10. The second bearing structure 46 is mounted within the second annular cavity 43, concentric to the first bearing structure 45 across the elongate frame 17. This concentric arrangement enables the clutch mechanism 14 to operate through the first bearing structure 45 and the second bearing structure 46, enabling the first resistance assembly 10 and the second resistance assembly 11 to be engaged or disengaged from a central location without regard to the relative orientation of either the first flywheel 39 or the second flywheel 41.

Further embodiments of the present invention support a data logging or metric-gathering functionality, enabling a user to accurately track performance during an exercise routine. More specifically, the chassis 15 further comprises a controller 47, at least one sensor 48, and a display 49. The controller 47 is electronically connected to the at least one sensor 48 and the display 49. The at least one sensor 48 is mounted to the chassis 15, wherein the at least one sensor 48 is configured to measure rotation of a first flywheel 39 of the first resistance assembly 10 and a second flywheel 41 of the second resistance assembly 11, and wherein measurement data is received by the controller 47. The display 49 is configured to execute display commands received from the controller 47, including both contemporaneous outputs of rotation data and historical data mapped and rendered over time. Across a variety of embodiments, the controller 47 broadly refers to any type of data processor or unitary monitoring system as may be realized by a reasonably skilled individual. Likewise, the at least one sensor 48 refers to any observational component suitable for converting rotational data into a machine-readable format for use by the controller 47. The display 49 constitutes an interface and output component, wherein the display 49 may be permanently associated with the present invention or implemented on an external device (e.g., smartphone, tablet, personal computer, or another similar device).

Figure 12:
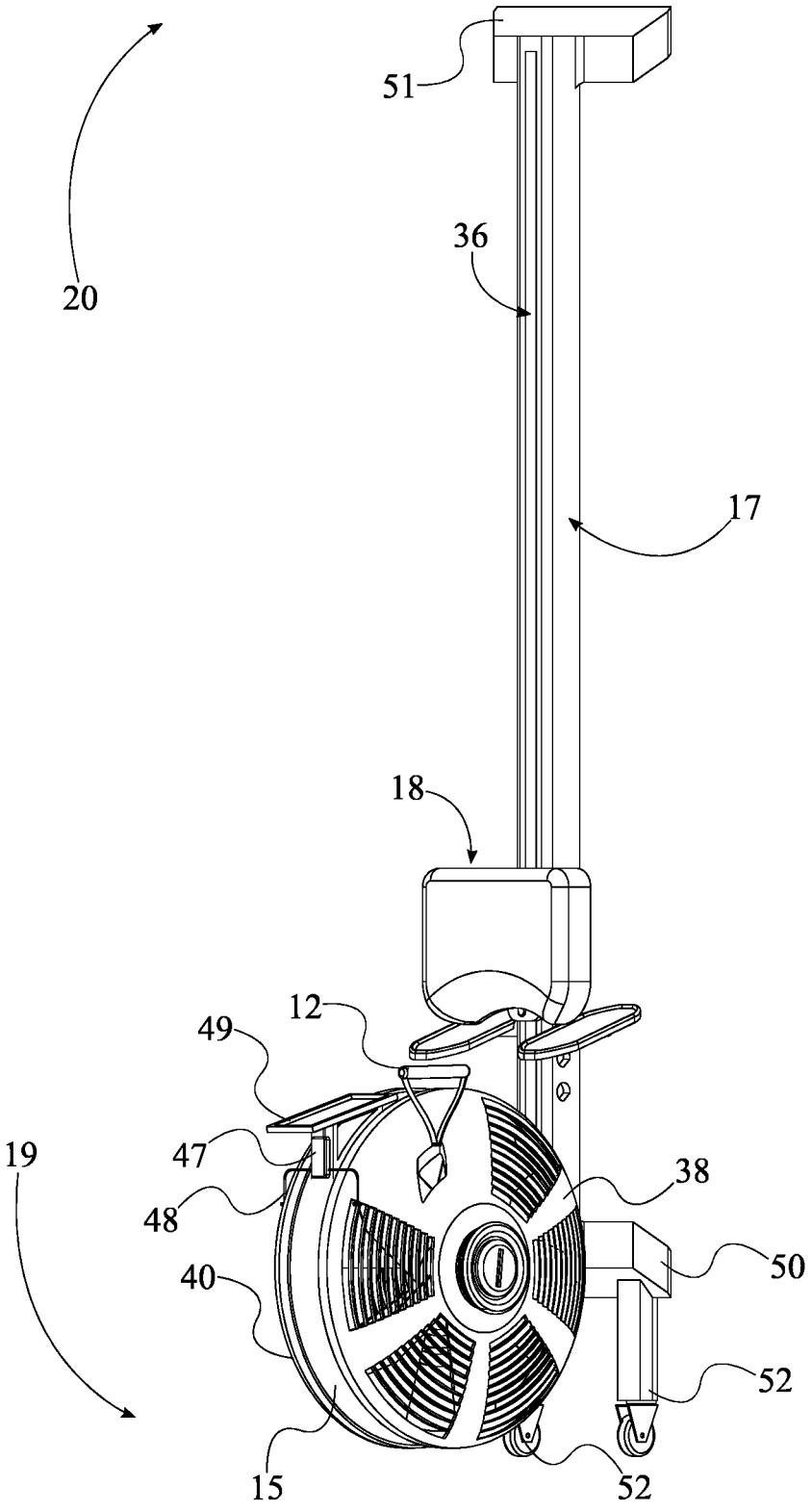
FIG. 12 is a top-left perspective view of the present invention, wherein the present invention is in an upright configuration for transport and storage.

As with many other conventional exercise equipment, it is recognized that deployments within a temporary 'home-gym' require frequent relocations of the present invention. For both ease of transport and space efficiency, it is contemplated that the present invention includes an integrated means of converting between a deployed, a stowed, and a transport configuration as shown in FIG. 12. More specifically, the elongate frame 17 further comprises a first support base 50, a second support base 51, and a plurality of casters 52. The first support base 50 is mounted to the proximal end 19 of the elongate frame 17, opposite to the chassis 15 across the elongate frame 17. The second support base 51 is mounted to the distal end 20 of the elongate frame 17. The first support base 50 and the second support base 51 provide a stable foundation for the present invention when deployed for use, preventing displacement of the present invention as the user works through an exercise routine. The first support base 50 or the second support base 51 also serve as upright supports in at least one alternate configuration, wherein the elongate frame 17 is positioned upright while not in use to minimize the floorspace required for storage. The plurality of casters 52 is distributed along the first support base 50, opposite the elongate frame 17 across the first support base 50 to enable the present invention to be wheeled between locations. In this interim configuration, the elongate frame 17 Is mobilized by tilting partially upright onto the plurality of casters 52, allowing a user to maneuver the present invention in a similar fashion to a hand cart or trolley.

Embodiments of the present invention are ideally configured to take advantage of any type or rotating resistance brake, including combinations thereof, to provide an optimal resistance force for exercise. As previously outlined, pressurized resistance elements (e.g., gas springs, hydraulic dampers, or other similar sealed cylinders) used in conventional exercise machines are prone to resistance fatigue as they become heat-soaked through repeated pressurizations. In contrast, rotating resistors provide consistent resistance across all rotational speeds and throughout any period of use.

In one embodiment, the first resistance assembly 10 and the second resistance assembly 11 are air turbines. The first resistance assembly 10 and the second resistance assembly 11 are configured to convert pneumatic resistance into tension against the first handle 12 and the second handle 13, wherein the air turbines resist movement against the air as they are forced to rotate by the user. This embodiment provides an added benefit in self-cooling and air circulation, as the user is effectively powering a manual air recirculation device throughout an exercise. This capacity for air recirculation may, in at least one embodiment, be directed to provide direct air cooling to the user or various parts of the present invention.

In another embodiment, the first resistance assembly 10 and the second resistance assembly 11 are fluid turbines, wherein the first resistance assembly 10 and the second resistance assembly 11 are configured to convert hydraulic resistance into tension against the first handle 12 and the second handle 13. This embodiment may utilize similar overall components to the air turbine embodiment, with the addition of a viscous fluid into the chassis 15 to provide greater resistance to the rotation of the first resistance assembly 10 and the second resistance assembly 11. It is further considered that the volume and type of viscous fluid may be adjusted to provide an analogue resistance adjustment, wherein greater volumes of fluid equate to greater resistance against the movement of the first handle 12 and the second handle 13.

In yet another embodiment, the first resistance assembly 10 and the second resistance assembly 11 are fluid turbines, wherein the first resistance assembly 10 and the second resistance assembly 11 are configured to convert hydraulic resistance into tension against the first handle 12 and the second handle 13. This embodiment may utilize similar overall components to the air turbine embodiment, with the addition of a viscous fluid into the chassis 15 to provide greater resistance to the rotation of the first resistance assembly 10 and the second resistance assembly 11. It is further considered that the volume and type of viscous fluid may be adjusted to provide an analogue resistance adjustment, wherein greater volumes of fluid equate to greater resistance against the movement of the first handle 12 and the second handle 13.

In additional embodiments, the first resistance assembly 10 and the second resistance assembly 11 are magnetic brakes, wherein the first resistance assembly 10 and the second resistance assembly 11 are configured to convert magnetic resistance into tension against the first handle 12 and the second handle 13. This embodiment provides ultimate variability in resistance force, wherein the overall braking force is fully adjustable via the adjustment of any magnetic element within the first resistance assembly 10 or the second resistance assembly 11. Further, the rotation of magnetic and conductive elements past each other produces useable electrical current; the user provides motive force for a dynamo generator by performing any standard exercise. This electrical energy may be recaptured and directed to various functions related to the operation of the present invention, including the provision of power to any external devices and components through appropriate connections.

Although the invention has been explained in relation to its preferred embodiment, it is to be understood that many other possible modifications and variations can be made without departing from the spirit and scope of the invention as hereinafter claimed.

What is claimed is:

1. A parallel resistance rowing machine comprising:

a first resistance assembly;

a second resistance assembly;

a first handle;

a second handle;

a clutch mechanism;
a chassis;
an axle;
an elongate frame;
a seat assembly;
the elongate frame extending between a proximal end and a distal end thereof;
the chassis being mounted to the proximal end of the elongate frame;
the axle being mounted to the chassis;
the first resistance assembly and the second resistance assembly being rotatably mounted to the axle;
the first resistance assembly and the second resistance assembly being positioned opposite each other across the axle;
the first handle being torsionally engaged to the first resistance assembly and the second handle being torsionally engaged to the second resistance assembly;
the clutch mechanism being operably engaged between the first resistance assembly and the second resistance assembly, wherein the first resistance assembly and the second resistance assembly are rotationally coupled by the clutch mechanism; and
the seat assembly being slidably mounted to the elongate frame, wherein the seat assembly traverses the elongate frame between the proximal end and the distal end.

2. The parallel resistance rowing machine as claimed in claim 1 further comprising:
the clutch mechanism comprising an arbor, a first engagement element, a second engagement element, a first receiver socket, and a second receiver socket;
the arbor being positioned concentric with the axle, wherein the arbor traverses between the first resistance assembly and the second resistance assembly;
the first engagement element being slidably mounted at a first terminal end of the arbor;
the second engagement element being slidably mounted at a second terminal end of the arbor, opposite the first engagement element;
the first receiver socket being formed into the first resistance assembly;
the second receiver socket being formed into the second resistance assembly; and
the first engagement element being operably engaged into the first receiver socket and the second engagement element being operably engaged into the second receiver socket, wherein the first resistance assembly and the second resistance assembly are rotationally coupled through the arbor.

3. The parallel resistance rowing machine as claimed in claim 2 further comprising:
the clutch mechanism further comprising at least one linear adjustment mechanism, a first spring, and a second spring;
the at least one linear adjustment mechanism being mounted to the arbor between the first engagement element and the second engagement element, wherein the at least one linear adjustment mechanism operably affects a length of the arbor between the first engagement element and the second engagement element;
the first spring being positioned between the first receiver socket and the first engagement element, wherein the first engagement element is biased away from the first receiver socket by the first spring; and
the second spring being positioned between the second receiver socket and the second engagement element, wherein the second engagement element is biased away from the second receiver socket by the second spring.

4. The parallel resistance rowing machine as claimed in claim 1 further comprising:
the seat assembly further comprising a bearing pin, a platform, and at least one locking mechanism;
the elongate frame comprising a seat channel extending between the chassis and the distal end;
the bearing pin being slidably mounted into the seat channel, wherein the seat assembly may traverse the elongate frame;
the platform being mounted atop the bearing pin, opposite the seat channel; and
the platform being releasably engaged to the elongate frame through the at least one locking mechanism.

5. The parallel resistance rowing machine as claimed in claim 4 further comprising:
the bearing pin being rotatably positioned within the seat channel; and
the platform being selectably oriented at an oblique angle to the elongate frame through the at least one locking mechanism.

6. The parallel resistance rowing machine as claimed in claim 1 further comprising:
the first resistance assembly further comprising a first shell and a first flywheel;
the second resistance assembly further comprising a second shell and a second flywheel;
the chassis further comprising a first annular cavity and a second annular cavity, wherein the axle traverses between the first annular cavity and the second annular cavity;
the first flywheel being positioned within the first annular cavity and the second flywheel being positioned within the second annular cavity;
the first shell being perimetrically mounted over the first annular cavity, wherein the first handle traverses through the first shell; and
the second shell being perimetrically mounted over the second annular cavity, wherein the second handle traverses through the second shell.

7. The parallel resistance rowing machine as claimed in claim 6 further comprising:
the axle comprising a first bearing structure and a second bearing structure;
the first bearing structure being mounted within the first annular cavity; and
the second bearing structure being mounted within the second annular cavity, concentric to the first bearing structure across the elongate frame.

8. The parallel resistance rowing machine as claimed in claim 1 further comprising:
the chassis further comprising a controller, at least one sensor, and a display;
the controller being electronically connected to the at least one sensor and the display;
the at least one sensor being mounted to the chassis, wherein the at least one sensor is configured to measure rotation of a first flywheel of the first resistance assembly and a second flywheel of the second resistance assembly, wherein measurement data is received by the controller; and
the display being configured to execute display commands received from the controller.

9. The parallel resistance rowing machine as claimed in claim 1 further comprising:

the elongate frame further comprising a first support base, a second support base, and a plurality of casters;

the first support base being mounted to the proximal end of the elongate frame, opposite to the chassis across the elongate frame;

the second support base being mounted to the distal end of the elongate frame; and the plurality of casters being distributed along the first support base, opposite the elongate frame across the first support base.

10. The parallel resistance rowing machine as claimed in claim 1 further comprising:

the first resistance assembly and the second resistance assembly being air turbines, wherein the first resistance assembly and the second resistance assembly are configured to convert pneumatic resistance into tension against the first handle and the second handle.

11. The parallel resistance rowing machine as claimed in claim 1 further comprising:

the first resistance assembly and the second resistance assembly being fluid turbines, wherein the first resistance assembly and the second resistance assembly are configured to convert hydraulic resistance into tension against the first handle and the second handle.

12. The parallel resistance rowing machine as claimed in claim 1 further comprising:

the first resistance assembly and the second resistance assembly being magnetic brakes, wherein the first resistance assembly and the second resistance assembly are configured to convert magnetic resistance into tension against the first handle and the second handle.

13. A parallel resistance rowing machine comprising:

a first resistance assembly;

a second resistance assembly;

a first handle;

a second handle;

a clutch mechanism;

a chassis;

an axle;

an elongate frame;

a seat assembly;

the elongate frame extending between a proximal end and a distal end thereof;

the chassis being mounted to the proximal end of the elongate frame;

the axle being mounted to the chassis;

the first resistance assembly and the second resistance assembly being rotatably mounted to the axle;

the first resistance assembly and the second resistance assembly being positioned opposite each other across the axle;

the first handle being torsionally engaged to the first resistance assembly and the second handle being torsionally engaged to the second resistance assembly;

the clutch mechanism being operably engaged between the first resistance assembly and the second resistance assembly, wherein the first resistance assembly and the second resistance assembly are rotationally coupled by the clutch mechanism;

the seat assembly being slidably mounted to the elongate frame, wherein the seat assembly traverses the elongate frame between the proximal end and the distal end;

the clutch mechanism comprising an arbor, a first engagement element, a second engagement element, a first receiver socket, and a second receiver socket;

the arbor being positioned concentric with the axle, wherein the arbor traverses between the first resistance assembly and the second resistance assembly;

the first engagement element being slidably mounted at a first terminal end of the arbor;

the second engagement element being slidably mounted at a second terminal end of the arbor, opposite the first engagement element;

the first receiver socket being formed into the first resistance assembly;

the second receiver socket being formed into the second resistance assembly;

the first engagement element being operably engaged into the first receiver socket and the second engagement element being operably engaged into the second receiver socket, wherein the first resistance assembly and the second resistance assembly are rotationally coupled through the arbor;

the elongate frame further comprising a first support base, a second support base, and a plurality of casters;

the first support base being mounted to the proximal end of the elongate frame, opposite to the chassis across the elongate frame;

the second support base being mounted to the distal end of the elongate frame; and the plurality of casters being distributed along the first support base, opposite the elongate frame across the first support base.

14. The parallel resistance rowing machine as claimed in claim 13 further comprising:

the clutch mechanism further comprising at least one linear adjustment mechanism, a first spring, and a second spring;

the at least one linear adjustment mechanism being mounted to the arbor between the first engagement element and the second engagement element, wherein the at least one linear adjustment mechanism operably affects a length of the arbor between the first engagement element and the second engagement element;

the first spring being positioned between the first receiver socket and the first engagement element, wherein the first engagement element is biased away from the first receiver socket by the first spring; and the second spring being positioned between the second receiver socket and the second engagement element, wherein the second engagement element is biased away from the second receiver socket by the second spring.

15. The parallel resistance rowing machine as claimed in claim 13 further comprising:

the seat assembly further comprising a bearing pin, a platform, and at least one locking mechanism;

the elongate frame comprising a seat channel extending between the chassis and the distal end;

the bearing pin being slidably mounted into the seat channel, wherein the seat assembly may traverse the elongate frame;

the platform being mounted atop the bearing pin, opposite the seat channel;

the platform being releasably engaged to the elongate frame through the at least one locking mechanism;

the bearing pin being rotatably positioned within the seat channel; and the platform being selectably oriented at an oblique angle to the elongate frame through the at least one locking mechanism.

16. The parallel resistance rowing machine as claimed in claim 13 further comprising:

the first resistance assembly further comprising a first shell and a first flywheel;

the second resistance assembly further comprising a second shell and a second flywheel;

the chassis further comprising a first annular cavity and a second annular cavity, wherein the axle traverses between the first annular cavity and the second annular cavity;

the first flywheel being positioned within the first annular cavity and the second flywheel being positioned within the second annular cavity;

the first shell being perimetrically mounted over the first annular cavity, wherein the first handle traverses through the first shell;

the second shell being perimetrically mounted over the second annular cavity, wherein the second handle traverses through the second shell;

the axle comprising a first bearing structure and a second bearing structure;

the first bearing structure being mounted within the first annular cavity; and the second bearing structure being mounted within the second annular cavity, concentric to the first bearing structure across the elongate frame.

17. The parallel resistance rowing machine as claimed in claim 13 further comprising:

the chassis further comprising a controller, at least one sensor, and a display;

the controller being electronically connected to the at least one sensor and the display;

the at least one sensor being mounted to the chassis, wherein the at least one sensor is configured to measure rotation of a first flywheel of the first resistance assembly and a second flywheel of the second resistance assembly, wherein measurement data is received by the controller; and the display being configured to execute display commands received from the controller.

18. The parallel resistance rowing machine as claimed in claim 13 further comprising:

the first resistance assembly and the second resistance assembly being air turbines, wherein the first resistance assembly and the second resistance assembly are configured to convert pneumatic resistance into tension against the first handle and the second handle.

19. The parallel resistance rowing machine as claimed in claim 13 further comprising:

the first resistance assembly and the second resistance assembly being fluid turbines, wherein the first resistance assembly and the second resistance assembly are configured to convert hydraulic resistance into tension against the first handle and the second handle.

20. The parallel resistance rowing machine as claimed in claim 13 further comprising:

the first resistance assembly and the second resistance assembly being magnetic brakes, wherein the first resistance assembly and the second resistance assembly are configured to convert magnetic resistance into tension against the first handle and the second handle.

* * * * *